US005655494A

United States Patent [19]

Donaldson, Jr.

[11] Patent Number: 5,655,494

[45] Date of Patent: Aug. 12, 1997

[54] VARIABLE ROLLER VALVE SYSTEM FOR INTERNAL COMBUSTION ENGINE

[75] Inventor: Robert D. Donaldson, Jr., Dallas, Tex.

[73] Assignee: Three Star Enterprises, Inc., Kingsland, Ga.

[21] Appl. No.: 597,394

[22] Filed: Feb. 8, 1996

Related U.S. Application Data

[62] Division of Ser. No. 296,439, Aug. 26, 1994, Pat. No. 5,572,967.

[51] Int. Cl.[6] ..... F01L 5/24

[52] U.S. Cl. ..... 123/190.17; 123/190.2

[58] Field of Search ..... 123/190.17, 190.1, 123/190.2

[56] References Cited

U.S. PATENT DOCUMENTS

| | | | |
|---|---|---|---|
| 1,189,625 | 7/1916 | Romberger | 123/190 |
| 1,283,121 | 10/1918 | Emery | 123/190.2 |
| 1,443,035 | 1/1923 | Olson | 123/190.2 |
| 3,948,227 | 4/1976 | Guenther | 123/32 |
| 3,993,036 | 11/1976 | Tischler | 123/190 |
| 4,114,639 | 9/1978 | Cross et al. | 123/190.17 |
| 4,163,438 | 8/1979 | Guenther et al. | 123/190 |
| 4,467,751 | 8/1984 | Asaka et al. | 123/190.17 |
| 4,481,917 | 11/1984 | Rus et al. | 123/190 |
| 4,606,309 | 8/1986 | Fayard | 123/190 |
| 4,794,895 | 1/1989 | Kruger | 123/190.17 |
| 4,920,934 | 5/1990 | Pizzicara | 123/80 |
| 4,949,685 | 8/1990 | Doland | 123/190 |
| 4,976,227 | 12/1990 | Draper | 123/80 |
| 4,976,232 | 12/1990 | Coates | 123/190.17 |
| 5,095,870 | 3/1992 | Place et al. | 123/190.4 |
| 5,105,784 | 4/1992 | Davis et al. | 123/337 |
| 5,154,147 | 10/1992 | Muroki | 123/190.17 |
| 5,205,251 | 4/1993 | Conklin | 123/190.12 |
| 5,309,876 | 5/1994 | Schiattino | 123/190.2 |
| 5,315,963 | 5/1994 | Warf | 123/190.012 |
| 5,329,897 | 7/1994 | Hemphill et al. | 123/190.17 |
| 5,372,104 | 12/1994 | Griffin | 123/190.17 |
| 5,392,743 | 2/1995 | Dokonal | 123/190.8 |
| 5,448,971 | 9/1995 | Blundell et al. | 123/65 |
| 5,526,780 | 6/1996 | Wallis | 123/190.17 |

FOREIGN PATENT DOCUMENTS

| | | |
|---|---|---|
| 2241925 | 9/1990 | Japan . |
| 3172521 | 7/1991 | Japan . |
| 284941 | 2/1928 | United Kingdom . |

*Primary Examiner*—Erick R. Solis
*Attorney, Agent, or Firm*—Fulbright & Jaworski L.L.P.

[57] ABSTRACT

A dynamic seal for containing gas flow between a roller valve and a cylinder in an internal combustion engine. Vents from the cylinder cavity allow pressure therefrom, particularly on the compression and power strokes, to exert a force against the back of a seal recessed into the outside of the engine block around a cylinder gas port. The force compresses the seal tighter against the roller valve.

4 Claims, 2 Drawing Sheets

VARIABLE ROLLER VALVE SYSTEM FOR INTERNAL COMBUSTION ENGINE

This is a division of application Ser. No. 08/296,439 filed Aug. 26, 1994, now U.S. Pat. No. 5,572,967.

PREAMBLE

This invention relates to a variable roller valve system for an internal combustion engine, and was invented by the applicant, Robert D. Donaldson, Jr., a United States citizen, of 4516 Lovers Lane, Suite 122, Dallas, Tex. 75225.

BACKGROUND OF THE INVENTION

This invention relates to a variable roller valve system for use in an internal combustion engine. A traditional feature of such engines is that the apertures and the relative timing of the intake and exhaust valves remain fixed during operation according to pre-adjusted settings. It is well recognized in the art, however, that dynamic control over intake and exhaust flow is required to optimize combustion efficiency and minimize noxious exhaust emissions over a range of operating speeds and power demands. The present invention provides this dynamic control.

The present invention achieves this dynamic control by improving on a basic rotary valve design. A Sliding Iris™ feature provides separate, independent, and continuous control over the aperture sizes of the intake ports and the exhaust ports while the engine is running. At the same time, and also while the engine is running, hydraulic mechanisms provide similar separate, independent and continuous control over the relative timing phases of the intake valve train and the exhaust valve train with respect to the crankshaft.

The result is unprecedented control over the combustion efficiency of the engine. A conventional control means, such as a computer, receives information from the operator, from the engine's environment, and from the engine itself. The control means then interprets the data received and instructs the present invention to adjust for optimum fuel flow and valve phase according to current operating conditions. With proper calibration, optimum combustion conditions can thus be maintained as the engine is operated through varying speeds, load demands and temperatures. This control over combustion provides a significant improvement in efficiency through the widest possible range of engine speeds and load demands, as well as a dramatic reduction in exhaust gas impurities.

The use of roller valves to gain dynamic control over intake/exhaust flow and valve phase is known in the art. Previous inventions have sought to vary roller valve port apertures by circumferential displacement of inner and outer members. Such inventions require elaborate control mechanisms, and potentially disrupt engine timing by altering valve duration. For example, Conklin, U.S. Pat. No. 5,205,251, discloses sleeves over solid rollers constricting valve apertures through relative circumferential displacement. Conklin does not disclose, however, how this displacement is physically actuated or synchronized with crankshaft rotation. Rus et al., U.S. Pat. No. 4,481,917, discloses coaxial annular shutter assemblies, one assembly rotating around the top of each cylinder about the cylinder's own axis. Rus requires a complex gearing mechanism to synchronize the independent operation of the two rotating valve members above each cylinder. Further, both these inventions alter valve duration as the valve port apertures are circumferentially constricted.

In contrast, the present invention's Sliding Iris™ feature varies valve port apertures through longitudinal displacement of inner and outer members. This improves on the prior art by simplifying the required control mechanism and by constricting valve port aperture without altering duration.

A further novel feature of this design is the dynamic seal used to enclose the cylinder cavity more tightly during the compression and power strokes. A pressure take-off from the inside of the cylinder cavity allows cylinder pressure to tighten the rotary valve seal directly against the valve roller. This eliminates the potential for valve seal leakage during high pressure cylinder conditions. This dynamic seal process is also apparently unknown in the art.

The prior art typically specifies sealing arrangements either as a function of close component tolerance, such as in Pizzicara, U.S. Pat. No. 4,920,984, or as a function of multi-component seals under constant mechanical spring pressure, such as in Place, U.S. Pat. No. 5,095,870. Both of the seal arrangements disclosed in these inventions are prone to gas blow-by and do not improve on the seal that would be provided by traditional "popper" valves.

The present invention's dynamic seal feature borrows from traditional "popper" valves and improves on the prior art by using cylinder pressure itself to tighten the seal positively during compression and power strokes. Further, potential seal wear is reduced as pressure against the seal is reduced during intake and exhaust strokes.

SUMMARY OF THE INVENTION

As noted, one object of this invention is to provide improved control over the gas flow dynamics of an internal combustion engine, thereby improving engine performance and fuel economy while reducing exhaust pollutant emission.

A related object of this invention is to improve the mechanical efficiency of an internal combustion engine by lowering mass, by eliminating inertial losses from continually reciprocating parts, and by reducing mechanical friction losses. The rotary valve design disclosed by the present invention weighs significantly less than its traditional "popper" valve counterpart because there is inherently less material required in its construction. Further, traditional "poppet" valves reciprocate continuously while the engine is running, causing inertial losses not suffered by the present invention. Finally, the friction losses inherent in an engine equipped with traditional "poppet" valves are usually significantly higher than those associated with an equivalent rotary valve design because the "poppet" valve design involves more interrelated moving parts. The present invention, based on a rotary design, thus reduces the engine's mass and its potential for inertial and friction losses, while its improved combustion gas management increases the engine's power potential. Overall mechanical efficiency is therefore improved, further enhancing engine performance and fuel economy.

Another object of this invention is to provide a dynamic seal to enclose the cylinder cavity more tightly during the compression and power strokes, as discussed above, thereby eliminating the potential for seal leakage during high pressure cylinder conditions.

Another object of this invention is to provide an engine that will operate using alternative fuels to gasoline, such as Liquified Petroleum Gas ("LPG") and other highly oxygenated fuels. These fuels generally combust more thoroughly and cleanly than gasoline, and have a higher octane rating than gasoline. As a result, these fuels achieve greater combustion efficiency than gasoline, with cleaner exhaust emissions. Up until now, however, engines running on these alternative fuels have found difficulty gaining acceptance because these fuels necessarily generate higher thermal shock waves when ignited. Generally, traditional "poppet" valve seats break down rapidly due to continuous direct exposure to these higher thermal shock waves. Valve seat breakdown causes the valve first to leak, and then ultimately to fail. The roller valve design in the present invention has no valve seats. Further, the dynamic seal disclosed in the present invention is ideally made from a polyamide material, or a ceramic material, that is immune to the thermal stress caused by ignition of highly oxygenated fuels. Moreover, the present invention positions the seal so as to shield it from thermal stress. As a result, there is no limitation on the use of alternative fuels by the present invention.

A further object of this invention is to provide an engine that minimizes cylinder head lubricant leakage through the valve guides and into the cylinders. This feature will reduce the unintentional combustion of lubricant and thereby limit further the creation of noxious exhaust emissions. A disadvantage of traditional "poppet" valve engines is that the valve guide introduces cylinder head lubricant into the cylinder every time the valve opens. This lubricant combusts and creates a noxious exhaust gas. The rotary valve design provided by the present invention calls for uniform seals around the variable valve apertures that isolate the apertures from contamination by lubricant. These seals eliminate lubricant leakage into the cylinders from the head.

A further object of this invention is to provide an engine that is easy to manufacture and maintain. As noted, the present invention involves fewer moving parts than a traditional "poppet" valve design. Further, the arrangement of these components into their assemblies is relatively uncomplicated as compared to an equivalent "poppet" valve design. Finally, the present invention offers the possibility of manufacturing the engine block from one piece, as discussed above. As a result, manufacture is simplified, and maintenance is made easier.

A further object of this invention is to provide a design that calls for a simple retrofit on most existing internal combustion engines. When retrofitting existing engines already manufactured with traditional cylinder heads, the present invention would be provided inside a self-contained replacement cylinder head assembly ideally dimensioned to be interchangeable with the existing one. Upon cylinder head replacement, a minor alteration to the arrangement of the timing belt and its pulleys would be needed to transfer drive power to the overhead roller valve assemblies. Conversion to an alternative fuel system such as LPG, if necessary, is a procedure that is already well known in the art.

These and other objects of the present invention will be apparent to those skilled in this art from the detailed description of a preferred embodiment of the invention set forth below.

BRIEF DESCRIPTION OF THE DRAWINGS

This invention will be further described in connection with the accompanying drawings, in which.

DETAILED DESCRIPTION OF THE INVENTION

The preferred embodiment herein is directed to a common four cylinder, 4-stroke engine as installed in many automobiles. The present invention is not limited to this application, however, and may be used on any internal combustion engine susceptible to being equipped with roller valves as disclosed herein.

Figure 1:
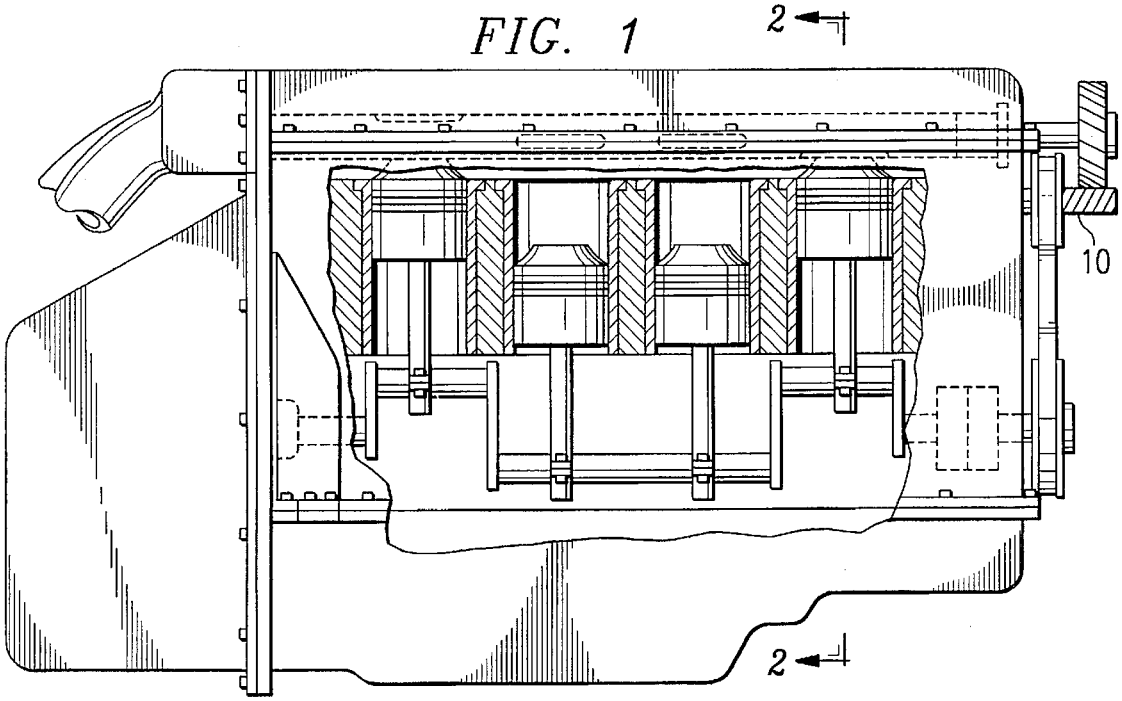
FIG. 1 is a cutaway view from the side into a standard in-line four cylinder, 4-stroke internal combustion engine. The present invention is installed in the cylinder head.
Figure 2:
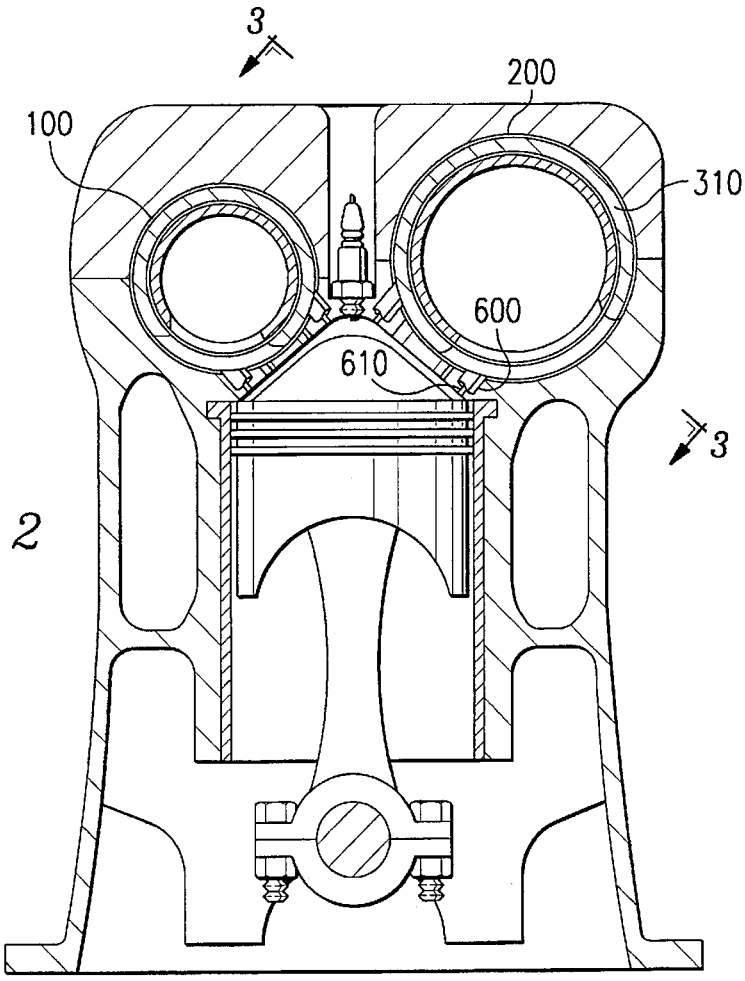
FIG. 2 is a section through the engine as shown on FIG. 1, showing the orientation of fie valve rollers at fie beginning of the intake stroke. The location of dynamic valve seal assemblies 600 is also shown.

As shown on FIG. 1 and FIG. 2, exhaust valve roller assembly 100 and intake valve roller assembly 200 rotate in the cylinder head of the engine to present apertures to the cylinders through which fuel is supplied and exhaust gas is removed. The rotation of valve roller assemblies 100 and 200 is synchronized with the engine crankshaft by linkage means 10.

The components and configurations of exhaust and intake valve roller assemblies 100 and 200 are substantially identical, except that ideally the surfaces of exhaust valve roller assembly 100 that are exposed to hot exhaust gas will be ceramic coated. The present invention has no specific requirement as to surface coating, however.

Also, the preferred embodiment herein discloses intake roller assembly 200 as larger in diameter than exhaust valve roller assembly 100. This feature reflects an expectation that in the four cylinder, 4-stroke engine chosen as the preferred embodiment herein, fuel will be taken into the engine at a lower pressure than the pressure at which exhaust will be driven out, requiring a larger diameter intake roller to provide equivalent intake and exhaust volume capacity. The particular needs of other engine designs fitted with the present invention, however, may dictate other relative roller diameters. The present invention has no specific requirement as to particular relative diameters of exhaust and intake valve roller assemblies 100 and 200.

Figure 3:
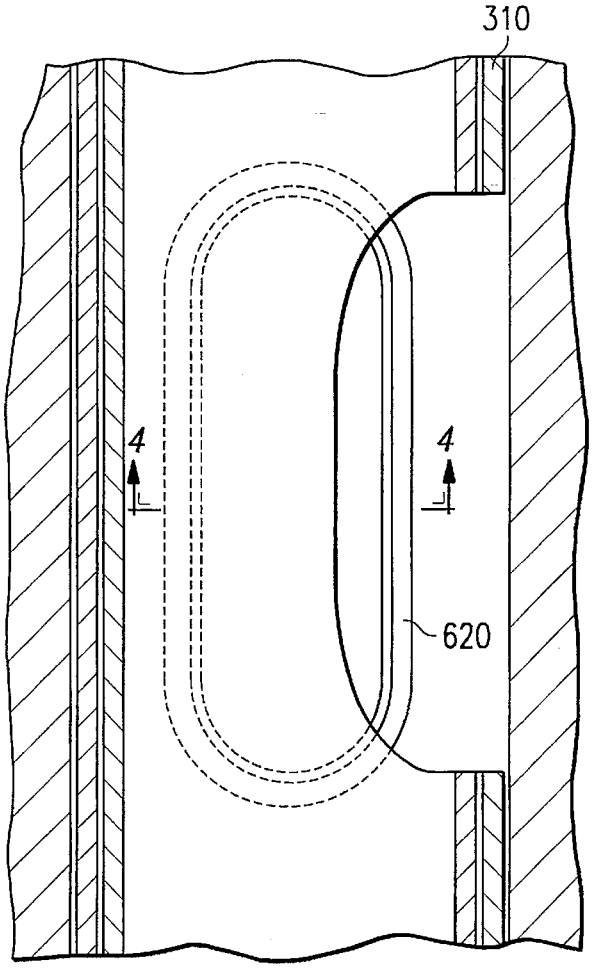
FIG. 3 is a partial section through the intake valve rollers as shown on FIG. 2, showing a valve port rotating past the dynamic valve seal. In this view, the valve apertures are wide open, and so the inner and outer valve ports are co-located.
Figure 4:
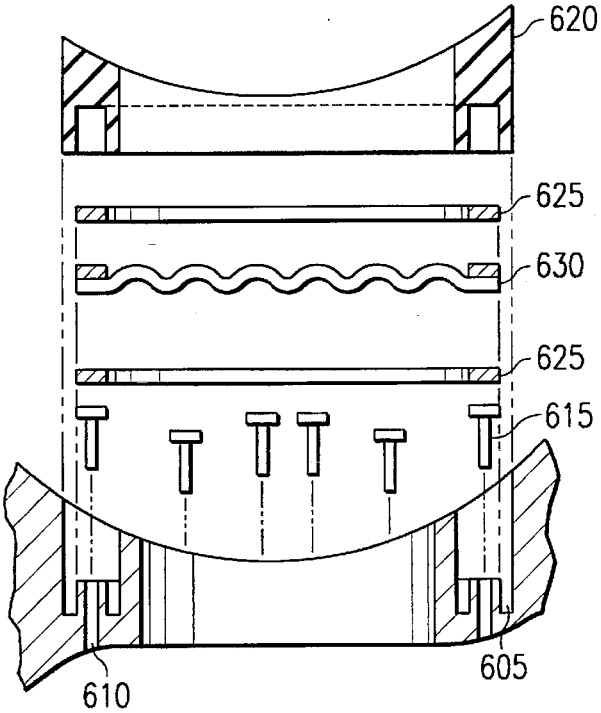
FIG. 4 is an exploded view of a dynamic seal assembly 600 previously shown in situ on FIG. 2.

As shown on FIG. 2, FIG. 3 and FIG. 4, dynamic seal assemblies 600 secure the engine cylinders from combustion leakage into valve roller assemblies 100 and 200 and particularly during the compression and power strokes. Each dynamic seal assembly 600 is received into a seal recess 605 located around each valve port opening in each engine cylinder. Pin holes 610 extend through seal recess 605 and into the cylinder cavity. Pressure applicator pins 615 are received into each pin hole 610. Engine cylinder pressure actuates pressure applicator pins 615 through pin holes 610 at times when seal 620 needs to be tightest. As pressure applicator pins 615 are forced outward by engine cylinder pressure, seal 620 is compressed against outer roller 310 through thrust plates 625 either side of spring plate 630.

The invention has been shown, described and illustrated in substantial detail with reference to a presently preferred embodiment. However, it will be understood by those skilled in the art that changes and modifications may be made without departing from the spirit and scope of the invention which is defined by the claims set forth hereunder.

Although the present invention and its advantages have been described in detail, it should be understood that various changes, substitutions and alterations can be made herein without departing from the spirit and scope of the invention as defined by the appended claims.

I claim:

1. A dynamic seal assembly for containing gas flow communication between a roller valve and an engine block in an internal combustion engine, the roller valve and the engine block each having openings in outer surfaces thereof, between which outer surfaces said dynamic seal assembly is disposed to contain said gas flow communication, the dynamic seal assembly comprising:

a seal recess, the seal recess provided on the outside surface of the engine block around each opening therein, the seal recess also providing one or more vents, each vent in combustion pressure communication with an engine cylinder in said internal combustion engine;

at least one pressure applicator pin, each pressure applicator pin received into a vent;

a spring plate, the spring plate received into the seal recess and over the pressure applicator pins;

a seal, the seal being continuous, the seal received into the seal recess and over the spring plate, the seal in compressive communication with both the spring plate and the outside surface of the roller valve;

first thrust plate means, the first thrust plate means located at points of contact between the pressure applicator pins and the spring plate; and second thrust plate means, the second thrust plate means located at points of contact between the spring plate and the seal.

2. A dynamic seal assembly for containing gas flow communication between a roller valve and an engine block in an internal combustion engine, the roller valve and the engine block each having openings in outer surfaces thereof, between which outer surfaces said dynamic seal assembly is disposed to contain said gas flow communication, the dynamic seal assembly comprising:

a seal recess, the seal recess provided on the outside surface of the engine block around each opening therein, one or more vents in the seal recess in combustion pressure communication with an engine cylinder in said internal combustion engine;

a seal, the seal received into the seal recess, the seal in compressive communication with the outside surface of the roller valve and disposed to be compressed thereon using combustion pressure from said engine cylinder;

means for compressing said seal against the outside surfaces of the roller valve using combustion pressure from said engine cylinder, wherein the means for compressing comprises:

one or more pressure applicator pins, each pressure applicator pin received into a vent in the seal recess; and a spring plate, the spring plate received into the seal recess and over the pressure applicator pins, the seal in compressive communication with both the spring plate and the outside surface of the roller valve.

3. The dynamic seal assembly of claim 2, in which the means for compressing further comprises:

first thrust plate means, the first thrust plate means located at points of contact between the pressure applicator pins and the spring plate.

4. The dynamic seal assembly of claim 2, in which the means for compressing further comprises:

second thrust plate means, the second thrust plate means located at points of contact between the spring plate and the seal.

* * * * *